US005961056A

United States Patent [19]

Heinemann

[11] Patent Number: 5,961,056

[45] Date of Patent: Oct. 5, 1999

[54] METHOD AND APPARATUS FOR FINE COMMINUTION OF GRANULAR MILL FEED MATERIAL

[75] Inventor: Otto Heinemann, Ennigerloh, Germany

[73] Assignee: Krupp Polysius AG, Beckum, Germany

[21] Appl. No.: 08/913,434

[22] PCT Filed: Apr. 4, 1996

[86] PCT No.: PCT/EP96/01494

§ 371 Date: Sep. 17, 1997

§ 102(e) Date: Sep. 17, 1997

[87] PCT Pub. No.: WO96/31277

PCT Pub. Date: Oct. 10, 1996

[30] Foreign Application Priority Data

Apr. 6, 1995 [DE] Germany ..... 195 13 016

[51] Int. Cl.[6] ..... B02C 19/00

[52] U.S. Cl. ..... 241/30; 241/254; 241/257.1

[58] Field of Search ..... 241/254, 252, 241/257.1, 207, 301, 30

[56] References Cited

U.S. PATENT DOCUMENTS

| | | | |
|---|---|---|---|
| 4,199,113 | 4/1980 | Genev | 241/252 |
| 4,721,260 | 1/1988 | Genev | 241/252 |
| 5,673,860 | 10/1997 | Heinemann et al. | 241/301 |

FOREIGN PATENT DOCUMENTS

| | | | |
|---|---|---|---|
| 2708053 | 9/1978 | Germany . | |
| 4227188 | 4/1993 | Germany . | |
| 667237 | 6/1979 | U.S.S.R. | 241/254 |

*Primary Examiner*—Mark Rosenbaum

*Attorney, Agent, or Firm*—Reising, Ethington, Barnes, Kisselle, Learman & McCulloch, PC

[57] ABSTRACT

A method and apparatus for comminuting granular mill feed material wherein the material is delivered in a stream to a gap between two rotary grinding tracks which confront one another, one of which is positioned at a small angle to the other so that in response to relative rotation of such tracks the width of the gap decreases to a minimum at an initial rate of at least 1 m/s. At the minimum width of the gap the material is subjected to comminuting pressure greater than 50 MPa.

10 Claims, 4 Drawing Sheets

METHOD AND APPARATUS FOR FINE COMMINUTION OF GRANULAR MILL FEED MATERIAL

The invention relates to a method for fine comminution of mill feed material, wherein the mill feed material in a granular mass is subjected to a pressure of over 50 MPa by pressing once between two opposing surfaces.

BACKGROUND OF THE INVENTION

The method for fine comminution is known for example from DE-B-27 08 053. In order to carry out this method so-called material bed roll mills may be considered which consist of two rolls which are pressed against one another with high pressure and are driven in opposite directions.

However, the efficiency of these roll mills is limited by the fact that the grinding tools, i.e. the rolls, have to transport the mill feed material into the pressing zone. In this case the "transport speed" is highly dependent upon the friction conditions of the as yet unpressed granular mass of material on the roll surface and upon how stable the material bed is in order to transfer the pressure. Thus the mill feed material is drawn into the grinding gap by the roll surfaces. The actual pressing begins at an angle of nip which is set automatically. The pressing speed at the beginning of the compression stress may be calculated on the basis of the peripheral speed of the grinding rolls. The pressing speed is understood here to mean the speed at which the distance between two opposing points on the surface of the two rolls is decreased.

The pressing speed at the start of the compression stress is in direct relation to the throughput of the roll mill. An increase in the efficiency of such mills is possible through an increase in the peripheral roll speed only in so far as the material feed through the roll transport before the pressing can keep pace with the pull-through speed in the pressing zone at the desired pressing density. Otherwise an interruption of the material flow is to be expected and the consequence is a high instability of the pressing operation. For this reason roll mills can only be operated at initial pressing speeds of about 0.5 m/s.

The object of the invention, therefore, is to improve the known method in such a way that the throughput is increased.

SUMMARY OF THE INVENTION

According to the invention the pressing of the material once between two opposing surfaces should take place in such a way that in the region of the pressing the distance between opposing points on the two surfaces at the start of the compression stress decreases at an initial speed of at least 1 m/s. In a preferred embodiment of the invention this method is implemented by the use of a ring mill, such as is known for example from DE-A-42 27 188. With regard to the construction of the ring mill reference is made to DE-A-42 27 188.

With the method according to the invention a very high energy efficiency and energy conversion is possible in the material bed comminution. Furthermore, it is possible to comminute very fine feed material and materials with a high voids fraction in the granular mass (inclusions of gas, air) as well as moist material and such material in which the voids fraction in the granular mass is filled with a fluid. The apparatus which operate by the method according to the invention are enormously efficient and can be operated with the highest throughput.

THE DRAWINGS

Further advantages and embodiments of the invention are explained in greater detail with the aid of the following description with reference to the drawing, in which.

THE PREFERRED EMBODIMENT

Figure 1:
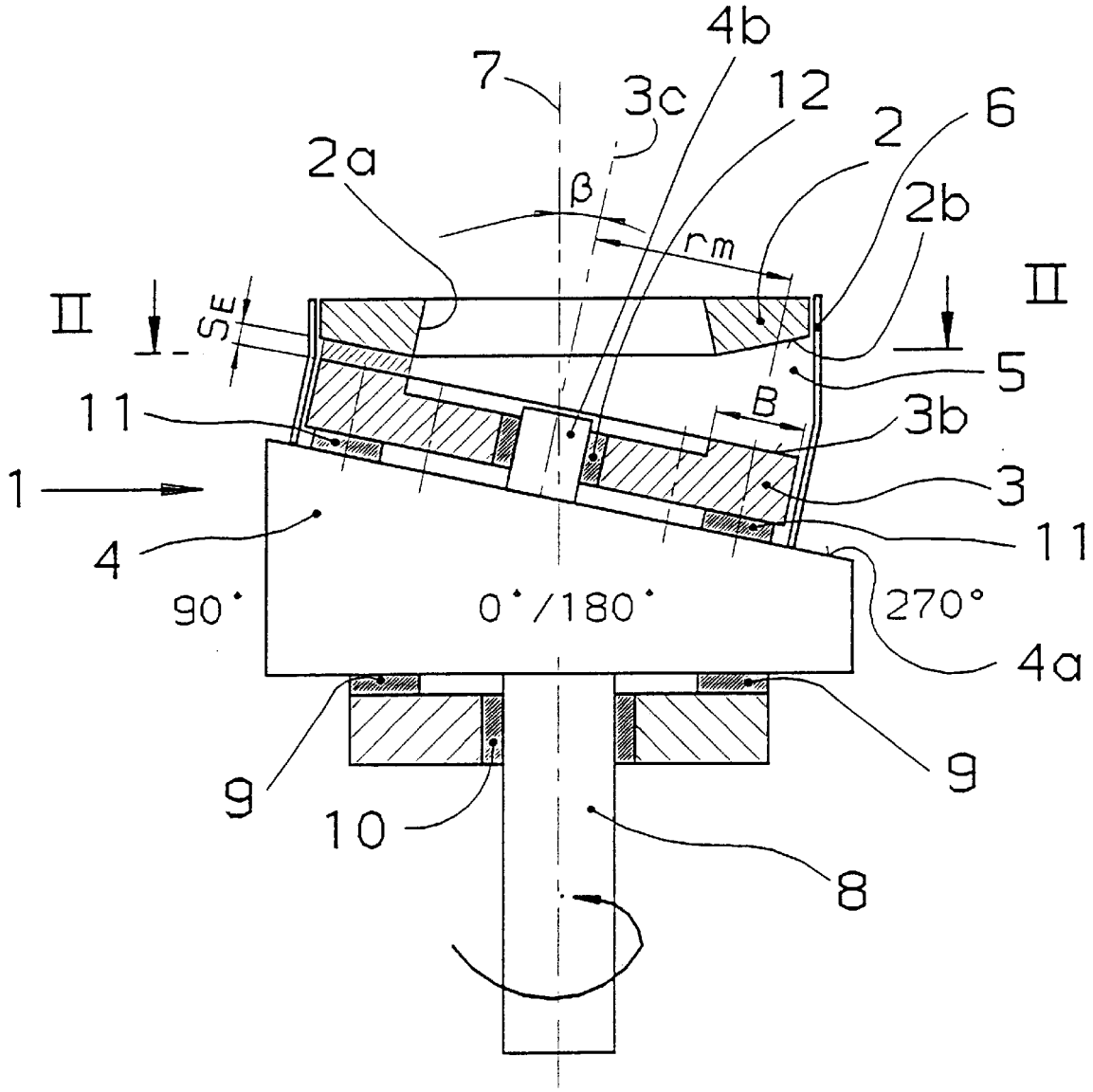
FIG. 1 shows a schematic sectional representation of a ring mill.

FIG. 1 shows a schematic sectional representation of a ring mill 1. Essentially it comprises a stationary first grinding track 2, a second grinding track 3 which is disposed below this first grinding track and is capable of wobble motion relative thereto, and a wobble plate 4 which can be driven by a suitable rotary drive arrangement (not shown). The wobble plate 4 serves to generate a wobbling movement of the lower second grinding track 3 in such a way that the width of the grinding gap 5 formed between the two grinding tracks 2, 3 periodically increases and decreases in the peripheral direction of the grinding tracks. In FIG. 1 the minimum or width of the grinding gap 5 between the two grinding tracks 2, 3 is shown in the left-hand half of the drawing and the greatest width is shown in the right-hand half of the drawing.

Figure 2:
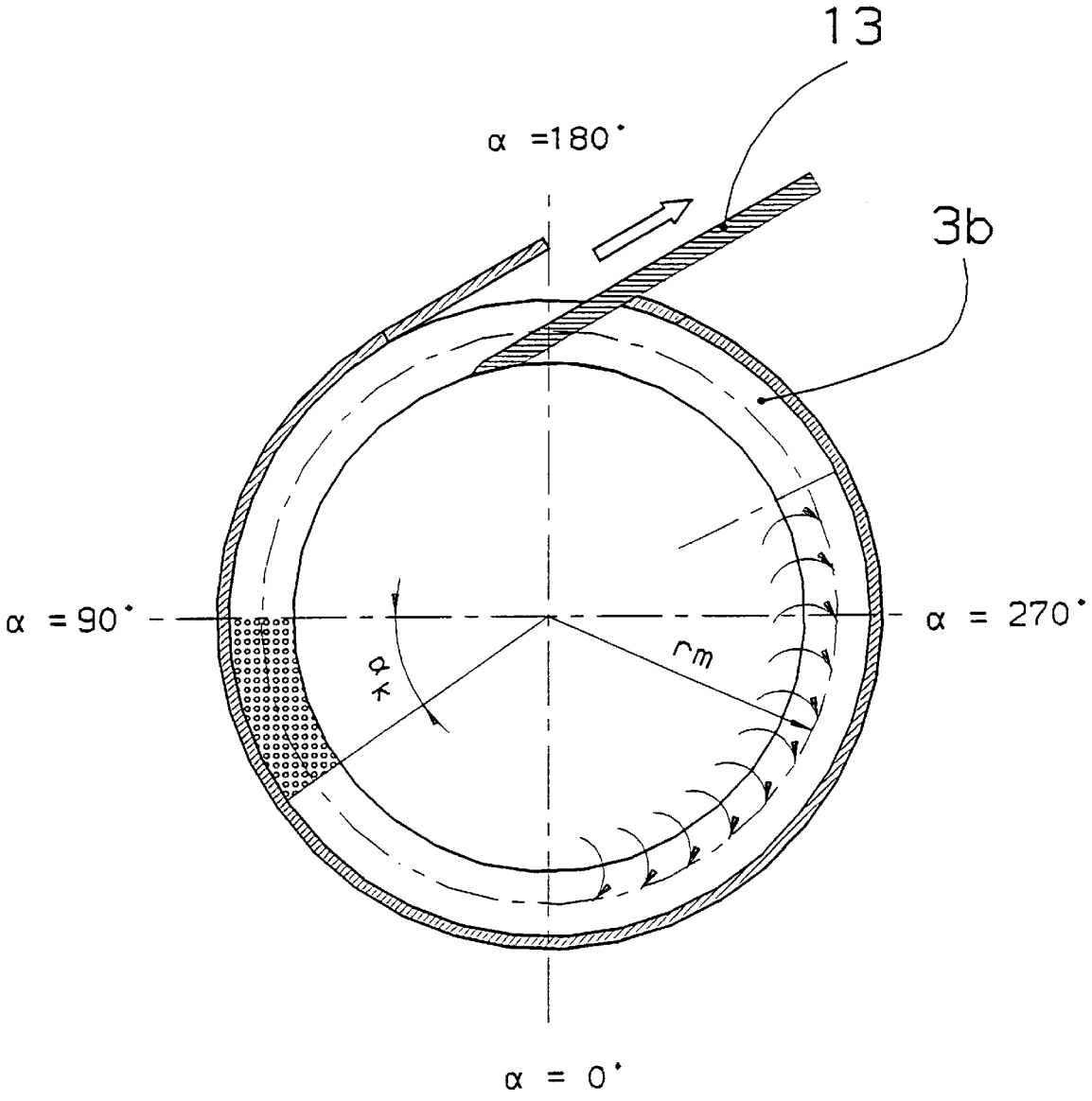
FIG. 2 shows a sectional representation along the line II—II in FIG. 1.

As can be seen from a study of FIGS. 1 and 2, the two grinding tracks 2, 3 are constructed as substantially flat annular tracks and inclined by a shallow angle relative to one another. The wobble plate 4 bears a cover 6 which revolves with it and by means of which the grinding gap 5 is covered against the exterior in at least a peripheral part-zone including the gap region with the greatest width.

The stationary first grinding track 2 is aligned substantially horizontally and is borne in a support which is not illustrated in greater detail. The second grinding track 3 which is capable of wobble motion is disposed below the first grinding track 2. In this case the first grinding track 2 has a central material feed opening 2*a* which opens opposite the centre of the second grinding track 3 and into which an arrangement which is suitable for delivering the mill feed material opens.

The two grinding tracks 2, 3 which lie opposite one another are substantially concentric with a vertical or at least approximately vertical axis 7 of the apparatus. This axis 7 coincides with the axis of rotation of a drive journal 8. This drive journal 8 projects so far downwards and outwards from the underside, which is opposite the second grinding track 3 and preferably aligned horizontally, that it can be connected to a rotary drive device lying below it.

The wobble plate 4 is axially supported in the apparatus support by way of a plurality of spaced axial thrust bearings 9 and radially guided by way of at least one radial bearing 10 provided on the drive journal 8. By contrast, the second grinding track 3 which is formed by a disc-shaped body and is capable of wobble motion is on the one hand supported by way of a plurality of axial thrust bearings 11 on the upper face 4*a* of the wobble plate 4 which is opposite the drive journal 8 and is inclined by a shallow angle relative to the horizontal, and on the other hand is radially guided by way of radial bearings 12 on a guide pin 4*b* which projects upwards at right angles from this inclined upper face 4*a* and is inclined relative to the axis 7 of the apparatus.

In the illustrated embodiment the second grinding track 3 has a completely level lower grinding surface 3*b* which faces upwards and is aligned perpendicular to its axis of rotation 3*c*. The first grinding track 2 likewise has a level grinding surface 2*b*, but this is inclined by the angle β relative to the horizontal. In this way the minimum width zone of the gap between the grinding surfaces 2*b*, 3*b* of the first and second grinding tracks 2, 3 lie substantially parallel opposite one another, as is shown at the left-hand half of FIG. 1. Naturally the grinding surfaces could also have any other suitable construction, such as for example a conical or concave shape.

The two grinding tracks 2, 3 are pressed against one another by a pressure arrangement which is not shown in greater detail. This pressure arrangement can for example be formed by an upper and lower clamping bar which co-operate with cylinder-piston units actuated by pressure medium. Such a pressure arrangement is known for example from DE-A-42 27 188.

In operation of the ring mill 1 a stream of the mill feed material is introduced by way of the material feed opening 2*a* of the first grinding track 2 and is delivered radially from the inner periphery to the grinding gap 5. The comminuted mill feed material is then discharged outwards over the outer periphery of the grinding gap 5. In order to facilitate large and maximum throughputs of this ring mill 1, an inner material discharge scraper 13 is provided which lies behind or downstream of the narrowest and before the greatest width of the grinding gap 6. This inner material discharge scraper 13 ensures in a reliable manner that previously comminuted mill feed material is certainly discharged and no blockage is caused in the grinding space or grinding gap region there.

Figure 3:
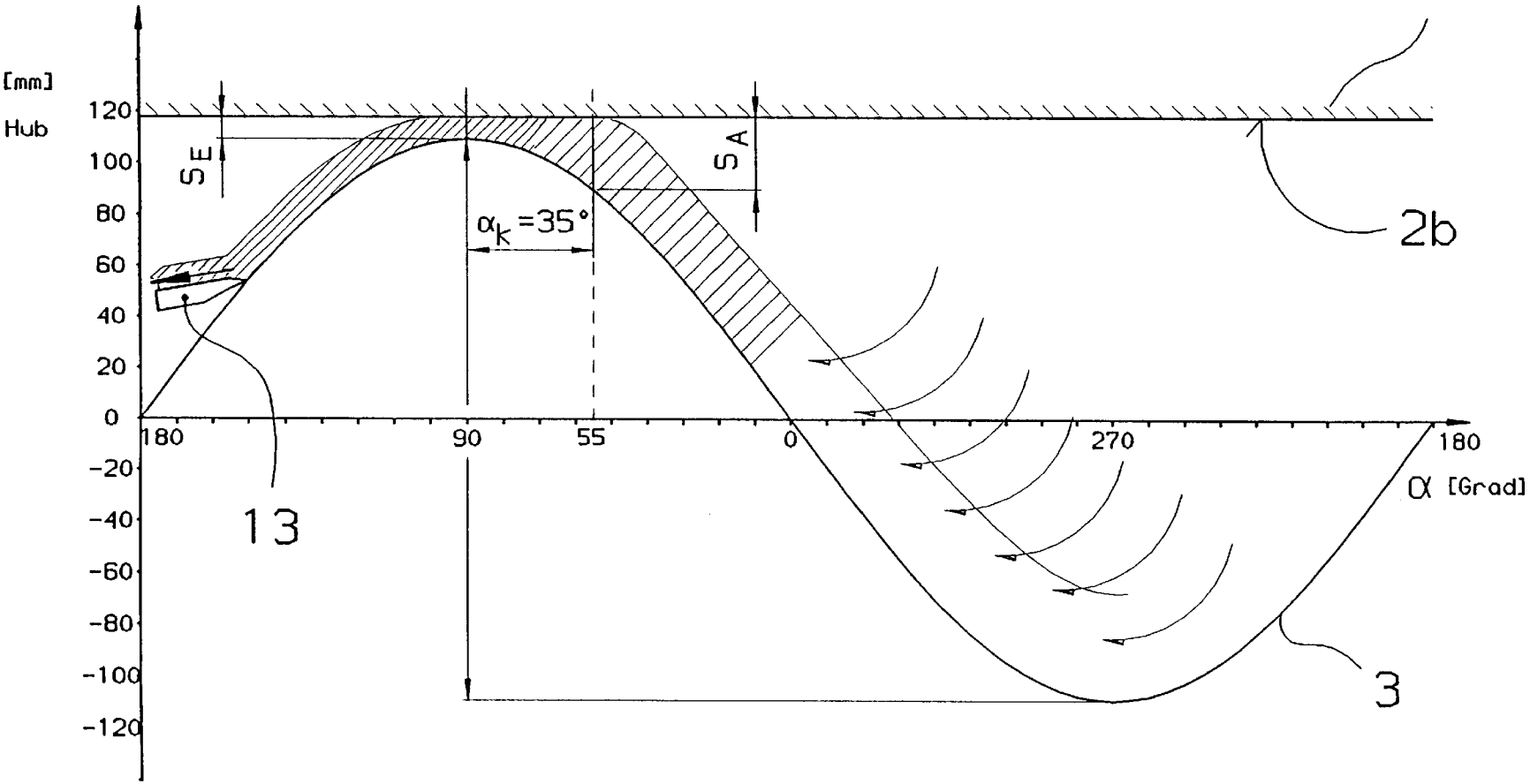
FIG. 3 shows a representation of the vertical movement over the angle of rotation and FIG. 4 shows a representation of the vertical speed over the angle of rotation.

The wobble plate 4 revolving at a certain speed causes a periodic enlargement or reduction in the thickness or width of grinding gap 5. In FIG. 3 the vertical movement of the second grinding track 3 relative to the first grinding track 2 is represented over the angle of rotation of the wobble plate 4. The angular positions α=0°, 90°, 180° and 270° are likewise shown in FIGS. 1 and 2.

At the angular position 90° the distance $S_E$ between the two grinding tracks 2, 3 is at its smallest, whilst the distance between the two grinding tracks at the angle of rotation of 270° is at its greatest. In the range of angles of rotation from approximately 200° to 0° the mill feed material is moved forward, i.e. it passes from the centre radially outwards onto the second grinding track 3. At an angle of rotation of approximately 0° a sufficient granular mass of feed material has built up. The actual compression stress begins at an angle of rotation of approximately 55° and ends at 90°, where the smallest grinding gap 5 is reached. Thus in this embodiment the actual pressing of the mill feed material takes place over an angular range of approximately 35°. Depending upon the type of mill feed material to be comminuted and the size of the ring mill the pressing can also take place over a greater angular range, for example up to 60°. At an angle of rotation of approximately 160° the comminuted mill feed material is discharged out of the ring mill by the material discharge scraper 13.

The tests on which the invention is based were carried out with the following parameters:

| | Test | | |
|---|---|---|---|
| | I | II | III |
| Mean grinding track radius [mm] | 525 | 525 | 525 |
| Width of grinding track [mm] | 200 | 200 | 200 |
| Scab thickness [mm] | 28 | 28 | 28 |
| Height of the granular mass at the start of compression [mm] | 48 | 48 | 48 |
| Grinding force [kN] | 6,393 | 6,393 | 6,393 |
| Peripheral speed of the compression zone in the centre of the grinding track [m/s] | 10 | 15 | 20 |
| Throughput [t/h] | 485 | 725 | 970 |
| Drive power [kW] | 1,290 | 1,935 | 2,580 |
| Maximum pressure [MPa] | 250 | 250 | 250 |

In the tests the lifting stroke of the second grinding track 3 as well as the vertical speed of this grinding track were measured over the different angular positions of the wobble plate 4. The vertical speed of the lower grinding track 3 at a specific angular position corresponds to the speed at which the distance between two vertically opposing points on the surfaces on the two grinding tracks 2, 3 decreases or increases.

In the tests the following values were determined:

| Angle | | Vertical speed at | | |
|---|---|---|---|---|
| α [degrees] | Stroke [mm] | 10 m/s [m/s] | 15 m/s [m/s] | 20 m/s [m/s] |
| 0 | 0.0 | 2.1 | 3.12 | 4.16 |
| 10 | 19.0 | 2.0 | 3.07 | 4.10 |
| 20 | 37.3 | 2.0 | 2.93 | 3.91 |
| 30 | 54.6 | 1.8 | 2.70 | 3.60 |
| 40 | 70.2 | 1.6 | 2.39 | 3.19 |
| 50 | 83.6 | 1.3 | 2.01 | 2.67 |
| 55 | 89.4 | 1.2 | 1.79 | 2.39 |
| 60 | 94.5 | 1.0 | 1.56 | 2.08 |
| 65 | 98.9 | 0.9 | 1.32 | 1.76 |
| 70 | 102.6 | 0.7 | 1.07 | 1.42 |
| 75 | 105.4 | 0.5 | 0.81 | 1.08 |
| 80 | 107.5 | 0.4 | 0.54 | 0.72 |
| 85 | 108.7 | 0.2 | 0.27 | 0.36 |
| 90 | 109.2 | −0.0 | −0.00 | −0.00 |
| 100 | 107.5 | −0.4 | −0.54 | −0.72 |
| 110 | 102.6 | −0.7 | −1.07 | −1.42 |
| 120 | 94.5 | −1.0 | −1.56 | −2.08 |
| 130 | 83.6 | −1.3 | −2.01 | −2.67 |
| 140 | 70.2 | −1.6 | −2.39 | −3.19 |
| 150 | 54.6 | −1.8 | −2.70 | −3.60 |
| 160 | 37.3 | −2.0 | −2.93 | −3.91 |
| 170 | 19.0 | −2.0 | −3.07 | −4.10 |
| 180 | −0.0 | −2.1 | −3.12 | −4.16 |
| 190 | −19.0 | −2.0 | −3.07 | −4.10 |
| 200 | −37.3 | −2.0 | −2.93 | −3.91 |
| 210 | −54.6 | −1.8 | −2.70 | −3.60 |
| 220 | −70.2 | −1.6 | −2.39 | −3.19 |
| 230 | −83.6 | −1.3 | −2.01 | −2.67 |
| 240 | −94.5 | −1.0 | −1.56 | −2.08 |
| 250 | −102.6 | −0.7 | −1.07 | −1.42 |
| 260 | −107.5 | −0.4 | −0.54 | −0.72 |
| 270 | −109.2 | 0.0 | 0.00 | 0.00 |
| 280 | −107.5 | 0.4 | 0.54 | 0.72 |
| 290 | −102.6 | 0.7 | 1.07 | 1.42 |
| 300 | −94.5 | 1.0 | 1.56 | 2.08 |
| 310 | −83.6 | 1.3 | 2.01 | 2.67 |
| 320 | −70.2 | 1.6 | 2.39 | 3.19 |
| 330 | −54.6 | 1.8 | 2.70 | 3.60 |
| 340 | −37.3 | 2.0 | 2.93 | 3.91 |
| 350 | −19.0 | 2.0 | 3.07 | 4.10 |
| 360 | 0.0 | 2.1 | 3.12 | 4.16 |

The stroke and the vertical speed of the second grinding track 3 are calculated as follows:

$$\text{stroke}=\sin(\beta)*rm*\sin(\alpha)$$

$$V_k=\sin(\beta)*rm*\cos(\alpha)*\text{omega}$$

with:

β [degrees]: angle of inclination between the two grinding tracks 2, 3 rm [m]: mean grinding track radius

α [degrees]: rotational angular position omega [1/s]: angular frequency

Figure 4:
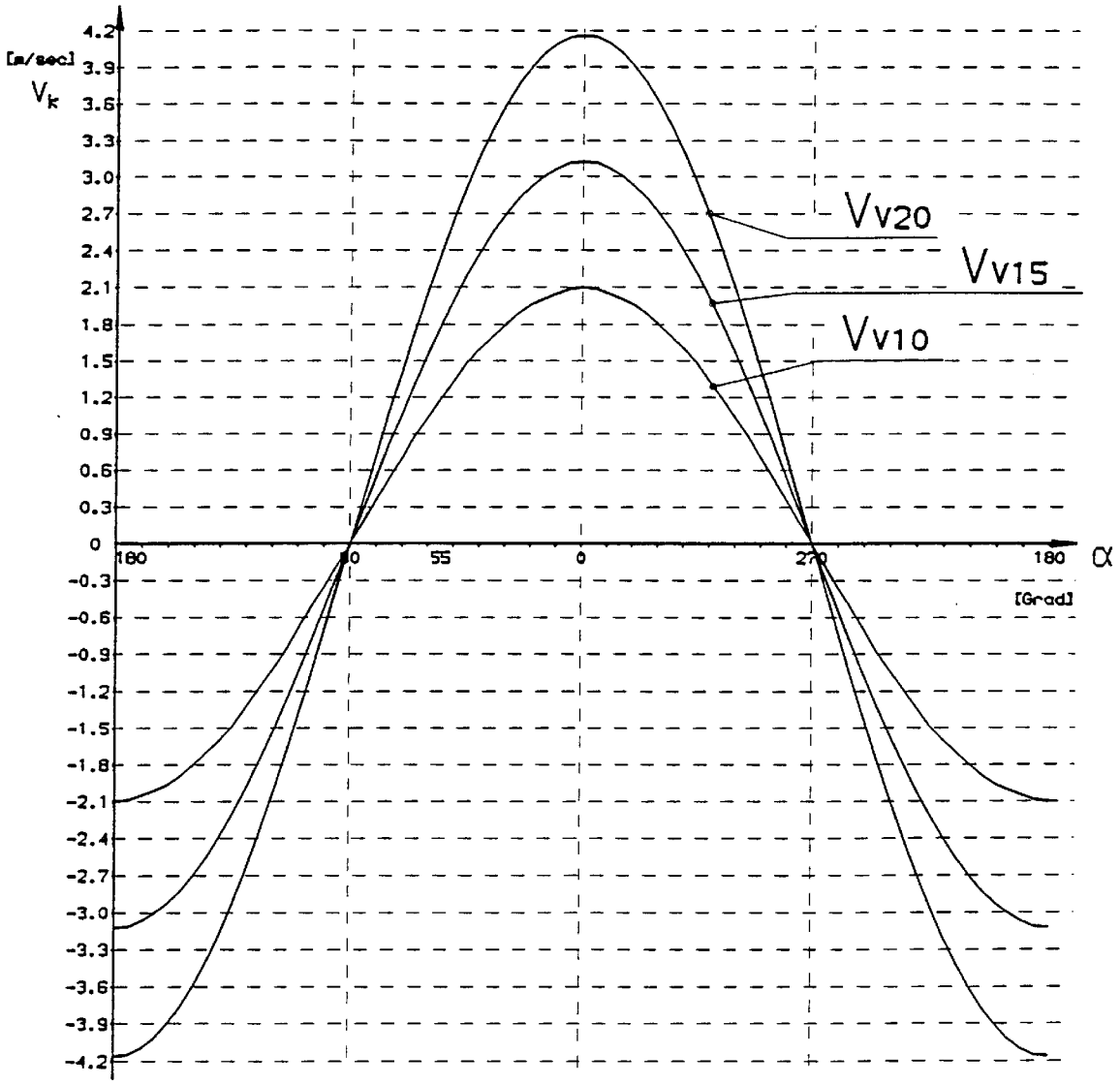

In FIG. 4 the vertical speed $V_k$ is shown over the angular position α for the three peripheral speeds 10, 15 and 20 m/s.

As can be seen very clearly from FIG. 4, the vertical speed, i.e. the initial speed at which the distance between opposing points on the surface of the two grinding tracks decreases, amounts to over 1 m/s at the start of the compression stress. In the concrete case, the vertical speed at a mean peripheral speed of the compression zone of 10 m/s is 1.2, at 15 m/s it is 1.79 and at 20 m/s it is 2.39 m/s.

The vertical speed, i.e. the speed of opposing points on the surface, decreases to 0 m/s until the maximum pressure is reached. The maximum pressure is over 50 MPa and can also reach values up to 500 MPa. The so-called material bed comminution takes placed at such pressures. The agglomerates formed thereby can be disagglomerated in a known manner in a subsequent apparatus.

In continuous systems such as in a ring mill, high initial speeds mean a high throughput potential with corresponding high energy conversions.

If at the start of the compression stress the ring mill is operated at an initial speed of at least 1 m/s, it is also possible to comminute feed material which is already very fine and materials with a high voids fraction in the granular mass as well as comminuting moist material and material in which the voids fraction in the granular mass is filled with a fluid. By contrast with a material bed roll mill which can be driven at an initial speed of at most 0.5 m/s, with a ring mill which is operated using the method according to the invention throughputs of at least double the size can be achieved. Thus the method according to the invention for material bed comminution is designed for maximum throughputs.

What is claimed is:

1. A method of comminuting granular material comprising delivering a stream of said material to a variable thickness gap between two relatively rotating grinding surfaces and reducing the thickness of said gap at a peripheral zone to a minimum and at an initial rate of at least 1 m/s, the thickness of said gap at said zone enabling said grinding surfaces to generate on said material at said zone a pressure greater than about 50 MPa.

2. The method according to claim 1 including removing comminuted material from said gap downstream of said zone.

3. The method according to claim 1 including increasing the thickness of said grinding gap downstream of said zone.

4. The method according to claim 1 wherein said grinding surfaces are annular and wherein one of said grinding surfaces is rotated relative to the other.

5. A method of comminuting granular material comprising delivering a stream of said material in sufficient quantity to occupy a variable thickness gap between two relatively rotatable grinding surfaces, and reducing at an initial rate of at least 1 m/s to a minimum the thickness of said gap at a peripheral zone thereof, thereby subjecting said material at said zone to a comminuting force.

6. Apparatus for comminuting granular material comprising a pair of confronting grinding members spaced apart a distance to form a grinding gap therebetween; means mounting one of said members at a shallow angle to the other for wobbling rotary movement; and means for rotating said one of said members for reducing at a rate at least as great as 1 m/s the width of said gap to a minimum at a peripheral zone at which granular material occupying said zone is subjected to comminuting force.

7. Apparatus according to claim 6 wherein said zone has an angular extent less than 90°.

8. Apparatus according to claim 7 wherein said zone has an angular extent less than 60°.

9. Apparatus according to claim 7 wherein the comminuting force to which granular material at said zone of said gap is subjected is greater than about 50 MPa.

10. Apparatus according to claim 7 including stationary diverting means downstream from said zone for removing comminuted material from said gap.

* * * * *